US005515671A

United States Patent [19]

Dür

[11] Patent Number: 5,515,671

[45] Date of Patent: May 14, 1996

[54] METHOD FOR BUILDING A SPECIFIC YARN RESERVE AT A ROTATING BALLOON LIMITER OF A MULTIPLE TWISTING SPINDLE AND A MULTIPLE TWISTING SPINDLE WITH ROTATING BALLOON LIMITER

[75] Inventor: Hansjorg Dür, Arbon, Switzerland

[73] Assignee: Hamel AG, Arbon, Switzerland

[21] Appl. No.: 212,593

[22] Filed: Mar. 11, 1994

[30] Foreign Application Priority Data

Mar. 11, 1993 [DE] Germany ..... 43 07 685.8

[51] Int. Cl.[6] ..... D01H 7/86

[52] U.S. Cl. ..... 57/58.83

[58] Field of Search ..... 57/58.52, 58.72, 57/58.76, 58.83, 58.84, 58.86

[56] References Cited

U.S. PATENT DOCUMENTS

| | | | |
|---|---|---|---|
| 2,127,921 | 8/1938 | Kent . | |
| 2,499,726 | 3/1950 | Cotterill | 57/58.83 X |
| 2,609,652 | 9/1952 | Halleux . | |
| 2,796,726 | 6/1957 | Klein | 57/58.33 X |
| 2,979,882 | 4/1961 | Bromley et al. | 57/58.83 X |
| 3,895,484 | 7/1975 | Greive et al. | 57/58.86 X |
| 5,303,550 | 4/1994 | Setzer | 57/58.86 X |

FOREIGN PATENT DOCUMENTS

| | | | |
|---|---|---|---|
| 1533414 | 7/1968 | France | 57/58.83 |
| 1268031 | 1/1964 | Germany . | |
| 3025698 | 2/1982 | Germany . | |
| 3728213 | 3/1988 | Germany . | |
| 3-76832 | 4/1991 | Japan | 57/58.83 |
| 417418 | 12/1964 | Switzerland . | |

*Primary Examiner*—Joseph J. Hail, III

*Attorney, Agent, or Firm*—Robert W. Becker & Associates

[57] ABSTRACT

A method of building a yarn reserve at a balloon limiter for a yarn guided after emerging from a spindle rotor into a yarn guide channel includes the step of connecting a yarn guide eyelet to an upper end of a balloon limiter so as to be positioned at an angular distance relative to an exit location of the yarn at the spindle rotor. The angular distance is adjusted between 20° and 120° as a function of operating conditions. The yarn is guided for building a yarn reserve through the yarn guide eyelet. The multiple twisting spindle for performing the inventive method has a spindle rotor having an exit location for a yarn and a rotating balloon limiter surrounding the spindle rotor and having at an upper end thereof at least one yarn guide eyelet. The yarn guide eyelet is spaced at an angular distance relative to the exit location of the yarn at the spindle rotor.

30 Claims, 5 Drawing Sheets

METHOD FOR BUILDING A SPECIFIC YARN RESERVE AT A ROTATING BALLOON LIMITER OF A MULTIPLE TWISTING SPINDLE AND A MULTIPLE TWISTING SPINDLE WITH ROTATING BALLOON LIMITER

BACKGROUND OF THE INVENTION

In twisting spindles for multiple yarns or yarns of a conventional design the rotating spindle portion (spindle rotor) is provided with a yarn storage disk about the periphery of which the yarn exiting radially from the hollow spindle shaft is collected with a greater or lesser length before the yarn under ballooning is guided to a yarn guide located on an extension of the spindle axis and further to a removal device or directly to a winding device. The yarn storage disk has the purpose of receiving between the radial outlet of the yarn from the spindle and the balloon to provide for a certain yarn reservoir that ensures a uniform yarn tension as well as a uniformly twisted thread. The yarn storage with a yarn storage disk can be defined as a thread brake without inertia.

Twisting spindles for multiple filaments or yarn without yarn storage disks require in general a forced guiding of the yarn balloon (U.S. Pat. No. 2,127,921; U.S. Pat. No. 2,609,652; German Patent 1,268,031). Such twisting spindles react very sensitively to changes of the inner yarn tension (removal tension) or the outer yarn tension (tension within the yarn balloon) which often results in breakage of the yarn. A forced yarn guide in the area of the yarn balloon is usually only suitable for very breakage-resistant yarns.

The solution disclosed in German Patent 1,268,031 takes into consideration this forced yarn guide. According to this document the force-guided yarn within the spindle rotor area is guided into a portion of the balloon limiter rotating with the spindle rotor. The compensation of the yarn tension takes place in the zone of the portion of the balloon limiter rotating with the spindle rotor or in a coaxial, cylindrically upwardly extending rotor.

In Swiss Patent 417,418 the storage disk is replaced by a balloon limiter that rotates together with the rotor of the twisting spindle.

In German Patent 37 28 213 a twisting device for a three-for-one twisting operation is disclosed in which the twisting spindle also does not have a storage disk. The yarn exiting from the hollow spindle shaft is guided to the edge of the spindle rotor and from there is transferred to the balloon limiter that rotates in the same direction as the spindle rotor. According to this publication it has been observed that for such twisting spindles the balloon yarn comes into contact with the inner wall of the balloon limiter only when the balloon limiter itself rotates. If this were not the case, the balloon yarn would be in contact with the lower portion at the outer mantle of the protective pot (compare also German Offenlegunggschrift 30 25 698).

The storage at the inner mantle of a balloon limiter rotating with the spindle rotor can be easily envisioned as a spatial curve of the yarn (slight spiral form). The balloon yarn, due to air friction, remains in the slot between the rotating spool support that may be rotated counter to the spindle rotor and the balloon limiter, respectively, the protective pot of the spool support, i.e., the yarn is slowed down. The spatial curve of the yarn begins at the outlet opening of the spindle rotor and ends at the transition of the highest contact location at the balloon limiter into a balloon yarn guide eyelet positioned at the spindle cover. In the case of spindles without a spindle cover the spatial curve ends directly at the balloon yarn guide eyelet.

Upon startup of the spindle the balloon yarn hits a standing air column which results in a slow-down relative to the rotating balloon limiter. The spatial curve of the yarn balloon extends over a certain circumference of the spindle with the consequence that the balloon yarn may wind spirally about the outer circumference of the inner protective pot of the spool support which rotates counter to the balloon limiter. Due to the friction of the threads the balloon yarn would be constricted resulting in breakage of the thread.

It is therefore an object of the present invention to provide a twisting device with a balloon limiter rotating with the spindle rotor for a multiple twisting operation (two-for-one and three-for-one) in which the rotating balloon limiter serves as a storage zone without the disadvantage of thread constriction about the spool pot during the startup phase of the spindle.

DESCRIPTION OF PREFERRED EMBODIMENTS

This object, and other objects and advantages of the present invention, will appear more clearly from the following specification in conjunction with the accompanying drawings, in which.

SUMMARY OF THE INVENTION

Figure 1:
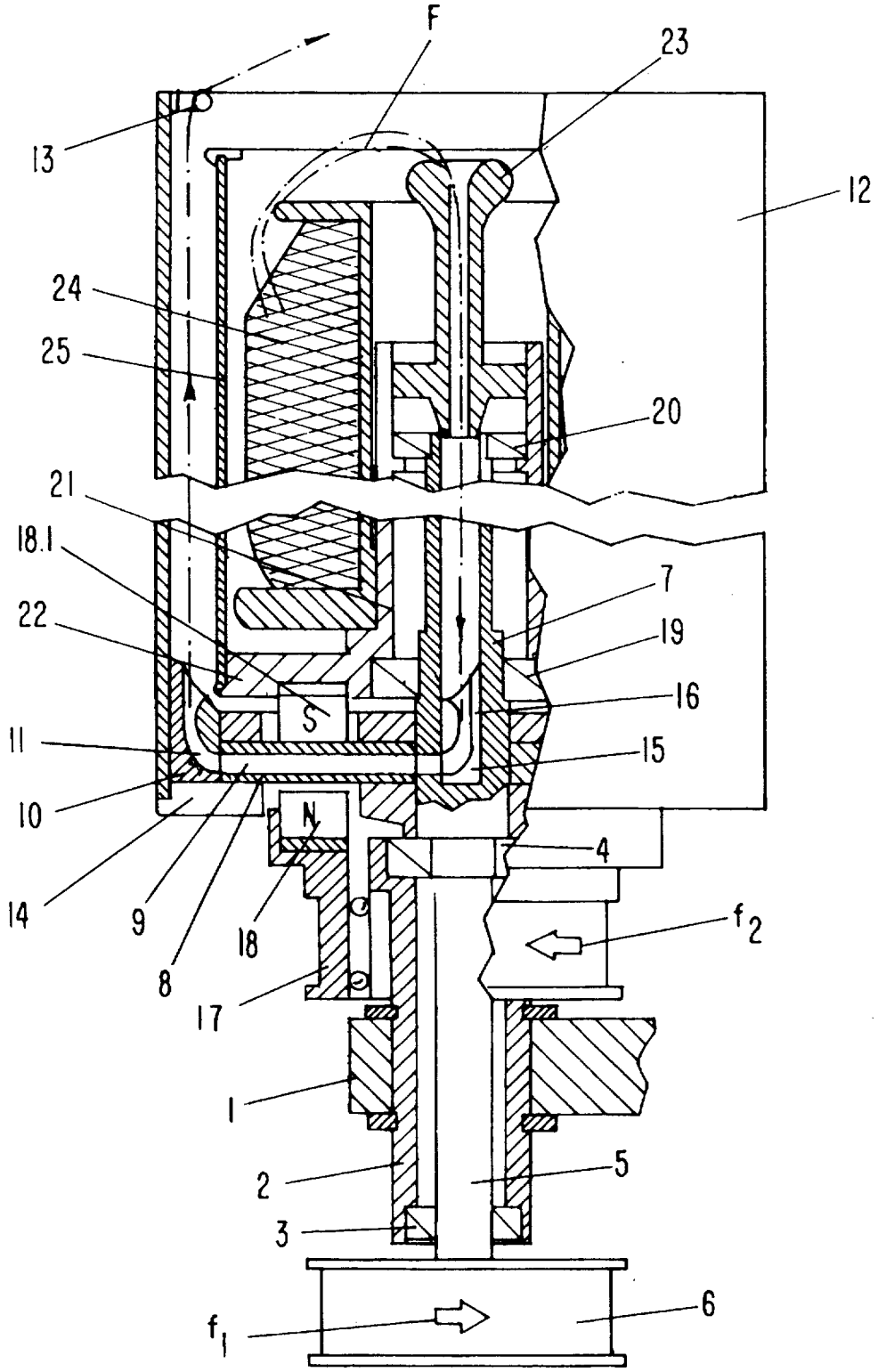
FIG. 1 shows an axial section of a twisting spindle for three-for-one twisting.

The method of building a yarn reserve at a balloon limiter for a yarn guided after emerging from a spindle rotor in a yarn guide channel is primarily characterized by:

Connecting a yarn guide eyelet to an upper end of balloon limiter so as to be positioned at an angular distance relative to an exit location of the yarn at the spindle rotor;

Adjusting the angular distance between 20 and 120° as a function of operating conditions; and Guiding a yarn for building a yarn reserve through the yarn guide eyelet;

The angular distance may be adjusted as a function of the geometric conditions of the spindle rotor and of the rotational speed of the spindle rotor. It may also be adjusted as a function of the geometric conditions of the spool support and the rotational speed of the spool support. Other parameters for adjusting the angular distance are the tension conditions of the yarn during removal from the yarn supply, the tension conditions of the yarns during removal from the spool support, and/or the properties of the yarn.

The multiple twisting spindle according to the present invention is primarily characterized by:

A spindle rotor having an exit location for a yarn; and

A rotating balloon limiter surrounding the spindle rotor and having at an upper end thereof at least one yarn guide eyelet, the yarn guide eyelet spaced at an angular distance relative to the exit location of the yarn at the spindle rotor.

Preferably, the at least one yarn guide eyelet is connected to an upper edge of the balloon limiter. Preferably, the upper edge of the balloon limiter is displaceable relative to the exit location of the yarn at the spindle rotor, preferably rotatably displaceable.

Expediently, the balloon limiter comprises two of the yarn guide eyelets positioned opposite one another.

Advantageously, the at least one yarn guide eyelet is spaced at an angular distance of 20° to 120° in a rotational direction of the spindle rotor relative to the exit location of the yarn at the spindle rotor.

Preferably, the at least one yarn guide eyelet has an elongate shape in a rotational direction of the balloon limiter. The at least one yarn guide eyelet preferably has a length corresponding to an angular distance of 10° to 20°.

Advantageously, the at least one yarn guide eyelet is connected in a displaceable manner to the balloon limiter.

Advantageously, the yarn guide eyelet is comprised of a bracket with a first and a second end and an elastically deformable holder. The first end of the bracket is elastically connected with the holder to the balloon limiter. The second end of the bracket preferably is beak-shaped, and the balloon limiter opposite the second end of the bracket has an opening. Preferably, the balloon limiter is displaceable relative to the exit location of the yarn at the spindle rotor. Advantageously, the balloon limiter is rotatably displaceable.

Expediently, the yarn guide eyelet is comprised of a bracket with a first and a second end and a clamping element displaceably clamped onto the balloon limiter. The first end is elastically pivotably connected to the clamping element. The second end of the bracket is preferably beak-shaped, and the balloon limiter opposite the second end of the bracket has a counter element for cooperating in an overlapping manner with the second end of the bracket. Preferably, the counter element is beak-shaped.

In another embodiment of the present invention, the yarn guide eyelet is comprised of a bracket with a first and a second end and a support element connected to the balloon limiter. The first end of the bracket is pivotably connected to the support element. The yarn guide eyelet further comprises a spring element engaging the first end of the bracket such that, when the balloon limiter is standing still, the yarn guide eyelet is forced into an open position. When the balloon limiter is in rotation, the second end of the yarn guide eyelet is closed due to centrifugal forces. Preferably, the balloon limiter has an upper end and comprises a rotary ring connected to the upper end. Advantageously, two yarn guide eyelets are connected to the rotary ring so as to be oppositely positioned.

Preferably, at least portions of the yarn guide eyelets that are contacted by the yarn are made of a wear-resistant material or are coated with a wear-resistant material.

Advantageously, the twisting spindle for twisting multiple yarns is in the form of a three-for-one twisting spindle wherein the balloon limiter is fixedly connected to the spindle rotor rotating in a first direction, and further comprises a spool support rotatable in a direction opposite the first direction.

In another embodiment of the present invention, the twisting spindle for twisting multiple yarns is preferably in the form of a two-for-one twisting spindle wherein the balloon limiter is fixedly connected to the spindle rotor.

Expediently, the yarn guide eyelet has a threading opening that in a circumferential direction of the balloon limiter is open in a direction toward the exit location at the spindle rotor. In the alternative, the yarn guide eyelet has a threading opening that in a circumferential direction of the balloon limiter is open in a direction facing away from the exit location of the yarn at the spindle rotor.

According to the present invention the yarn guide eyelet is preferably connected to the upper edge of the balloon limiter that is still just barely touched by the yarn. The yarn guide eyelet is positioned at a certain angular distance relative to the radial exit location of the yarn from the spindle rotor, preferably at an angular distance between 20° and 120°.

The yarn guide eyelet in the circumferential direction of the inner mantle of the balloon limiter is provided with an elongate opening which allows the yarn to swing freely within this length. This is always the case when the yarn balloon, due to changing inner or exterior yarn tension, must adjust to such tension changes. The yarn, respectively, the yarn balloon can swing within the frame of the elongate yarn guide eyelet corresponding to the required tension adaptation. The circumferential length of the yarn guide eyelet in any working position should be approximately +/−15° relative to the adjusted angular distance of the yarn guide eyelet position. The yarn guide eyelet is preferably designed such that the yarn, depending on the direction of rotation of the spindle, is automatically threaded into the yarn guide eyelet. In order to take into consideration opposite spindle rotation directions, at the circumference of the balloon limiter two diametrically opposed yarn guide eyelets are provided. This measure also maintains the balance of the rotating balloon limiter.

The yarn guide eyelets are connected to the balloon limiter such that they can be displaced within a range of between 20° and 120° relative to the radial exit location of the yarn from the spindle rotor.

When the yarn guide eyelet is fixedly connected to the upper edge of the balloon limiter, a portion of the balloon limiter can be rotated relative to the radial exit location of the yarn at the spindle rotor in order to be able to attain the desired angular distance $\alpha$.

The object of the present invention, i.e., a safe yarn storage or yarn reserve within the yarn balloon can only be achieved when it is ensured that the yarn does not have a tendency for winding itself about the protective pot of the spool support. Such a storage can be achieved without a forced guiding of the yarn by providing the yarn guide eyelet at a certain angular distance to the radial exit location of the yarn at the spindle rotor in the area of the upper edge of the balloon limiter.

DESCRIPTION OF PREFERRED EMBODIMENTS

The present invention will now be described in detail with the aid of several specific embodiments utilizing FIGS. 1 through 11.

FIG. 1 shows as a representative component of a twisting machine a part of a spindle rail 1 in which a spindle bearing sleeve 2 is stationarily supported. In the spindle bearing sleeve 2 a spindle shaft 5 is rotatably supported with bearings 3 and 4, whereby at the lower end of the spindle shaft 5 a spindle whorl 6 is connected that is rotatably driven in the direction of arrow f1. At the upper end of the spindle shaft 5 a hollow spindle shaft 7 is provided the lower end of which has connected thereto a turntable 8 with a radially extending yarn guide channel 9. The turntable 8 is surrounded by a ring 10 that has a deflecting channel 11 which is connected to the yarn guide channel and extends first radially and then axially upwardly. Connected to the ring 10 is an upwardly extending balloon limiter 12 which in its upper area, preferably at its upper balloon limiter edge, is provided with a yarn guide eyelet 13 positioned at an angular distance from the radial exit location of the yarn guide channel 9. To the lower edge of the balloon limiter 12 an annular body 14 is connected which is essentially flange-shaped. A yarn deflecting body 15 is inserted into the lower end of the hollow spindle shaft 7 which deflecting body 15 has a yarn deflecting channel 16 with an axial channel section and a radial channel section that opens into the yarn guide channel.

A spool support whorl 17 is rotatably supported on the spindle bearing sleeve 2 and rotatable counter to the direction of rotation of the spindle whorl 6 in the direction of arrow f2. Follower magnets 18 are inserted into the upper sleeve-shaped end of the spool support whorl 17 which magnets extend along a circular path and also below the turntable 8 into an annular space.

A sleeve-shaped spool support hub 21 is rotatably supported with bearings 19 and 20 on the hollow spindle shaft 7. The hub 21 at its lower end is provided, for example, with a stepped spool support bottom 22 that supports at its outer circumference a spool support protective pot 25. At the underside of the spool support bottom 22 counter magnets 18.1 are connected opposite to the follower magnets 18 which with respect to the follower magnets 18 are polarized such that upon rotating the whorl 17 of the spool support the spool support hub 21, the spool support bottom 22, and the protective pot 25, which together constitute the spool support, are rotated in the same direction of rotation. Into the upper end of the spool support hub 21 a yarn inlet tube 23 is arranged concentrically to the hollow spindle axis 7. A supply spool 24 is slipped onto the spool support hub 21 and rests on the stepped spool support bottom 22 such that the supply spool 24 upon rotation of the spool support 21, 22 can be rotated without slip.

When the spindle rotates, the yarn F is removed upwardly from the supply spool 24 and guided through the yarn inlet tube 23 and the hollow spindle shaft 7 first downwardly and then radially outwardly through the radial yarn guide channel 9 and then axially upwardly between the spool support protective pot 25 and the balloon limiter to a yarn guide eyelet 26 (FIG. 2) that is located on an extension of the hollow spindle shaft. From this location the yarn is then further guided to a non-represented winding device. In order to provide for a sufficient yarn reserve the yarn is guided through the yarn guide eyelet 13 that is positioned at a suitable angular distance from the exit location of the yarn at the radially oriented yarn guide channel 9, respectively, of the yarn deflecting channel 11.

Preferably, two yarn guide eyelets 13 are provided opposite one another in order to avoid imbalance and in order to ensure a uniform rotation of the balloon limiter. The presence of two diametrically oppositely arranged yarn guide eyelets also allows for operating the inventive method in both directions of rotation of the balloon limiter 12 on the one hand, respectively, of the spool support represented in FIG. 2 by the protective pot 25 representing the spool support.

Figure 2:
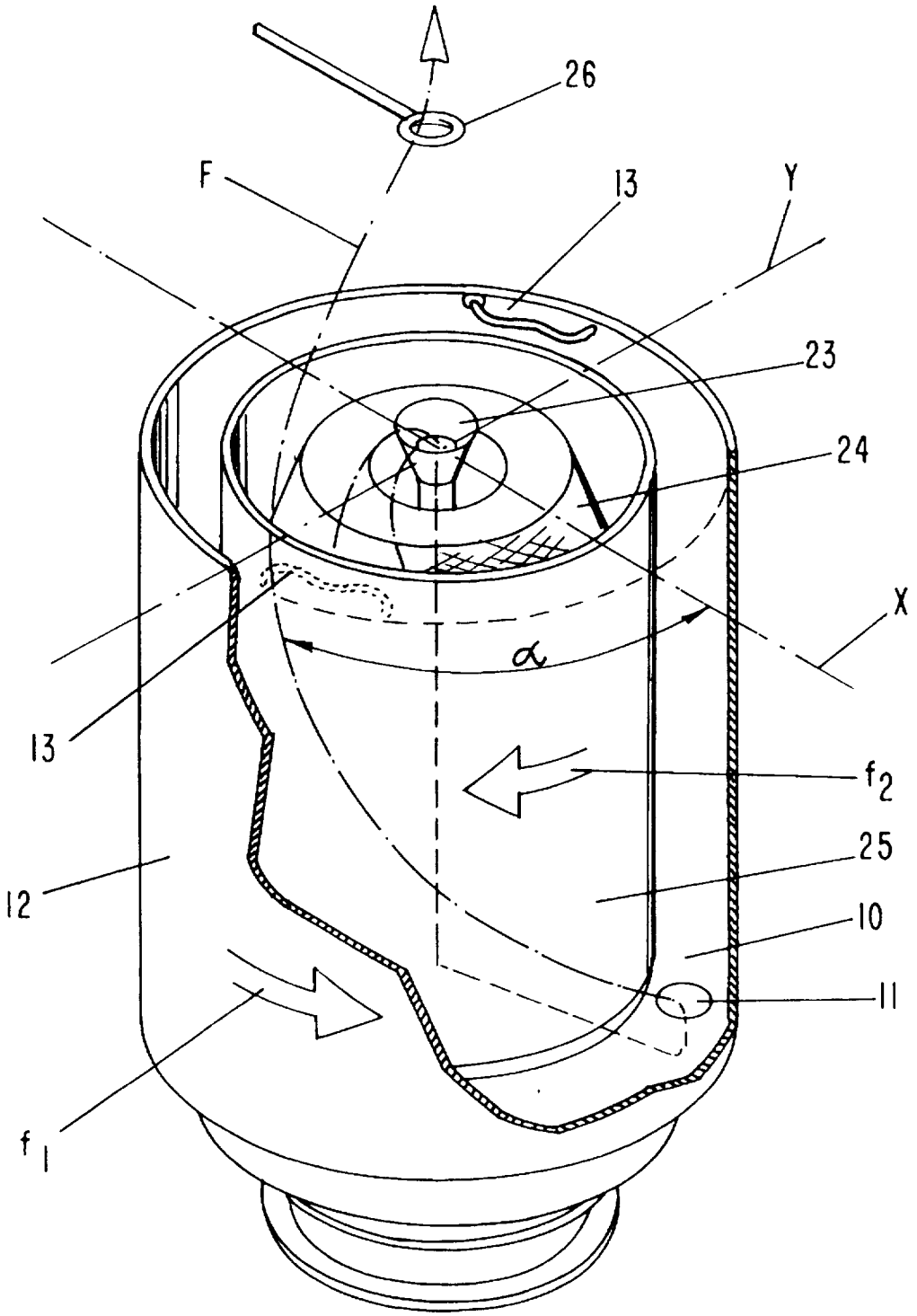
FIG. 2 shows a perspective view of the twisting spindle of FIG. 1 with portions broken away.

From the perspective representation of FIG. 2 with partially broken away balloon limiter 12 the partially spiral extension of the yarn along the inner wall of the balloon limiter between the exit of the yarn deflecting channel 11 and the yarn guide eyelet 13 is visible. The inner wall of the balloon limiter 12 rotating in direction of the arrow f1 is used as a storage zone so that in the startup phase of the spindle no thread constriction takes place about the spool pot 25 rotating in the counter direction f2 of arrow f1. As a function of the rotational movement of the spindle and the yarn material to be twisted, the yarn guide eyelet 13 is preferably positioned at an angle of between 20° and 120° spaced from the exit opening of the yarn deflecting channel 11.

In FIG. 2 the aforementioned angular distance is represented by the angle $\alpha$ defined by the axial plane through the x-coordinate in which the yarn deflecting channel 11 is positioned, on the one hand, and the passage location of the yarn through the yarn guide eyelet 13, on the other hand.

The yarn guide eyelet 13 in the circumferential direction of the balloon limiter 12 has an elongate form which allows the yarn F to swing within the length of the opening so that the yarn balloon can adapt to yarn-dependent and operation dependent yarn tensions. The yarn guide eyelet 13 in the circumferential direction preferably has a circumferential length corresponding to +/−15° to the central angular position of the yarn Guide eyelet 13 relative to the yarn deflecting channel 11.

According to FIG. 2 the yarn guide eyelets 13 are fixedly connected to the upper edge of the balloon delimiter 12 in diametrically opposite locations. In order to be able to adjust the position of the respective yarn guide eyelet 13 relative to the yarn deflecting channel 11, it is inventively suggested to make the balloon limiter 12 or at least a portion of the balloon limiter displaceable, respectively, rotatable relative to the yarn deflecting channel 11.

From FIG. 2 it may be taken that when a yarn guide eyelet 13 is missing at the upper rotating edge of the balloon limiter 12, an undesirable winding of the yarn about the inner protective pot 25 takes place rather quickly which, as mentioned before, will result due to the thread friction effect to a breakage of the yarn.

Figure 3:
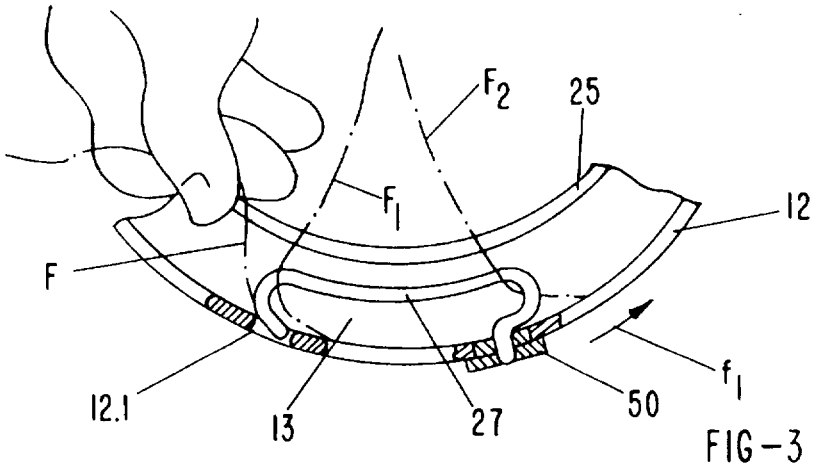
FIG. 3 shows a portion of the balloon limiter in a first embodiment with a yarn guide eyelet connected to the balloon limiter.

FIG. 3 shows an embodiment with a yarn guide eyelet 13 to be threaded by hand. It is in the form of a bracket 27 that is clamped with an elastically deformable holder 50 in an elastic manner at the balloon limiter 12. The free beak-shaped end of the bracket 27 can then penetrate an opening 12.1 at the balloon limiter 12 upon rotation of the balloon limiter due to the resulting centrifugal forces. In this manner a closed yarn guide eyelet 13 is formed which prevents, even for extreme positions F1 and F2 between which the yarn F may swing, exiting of the yarn from the yarn guide eyelet 13.

Figure 4:
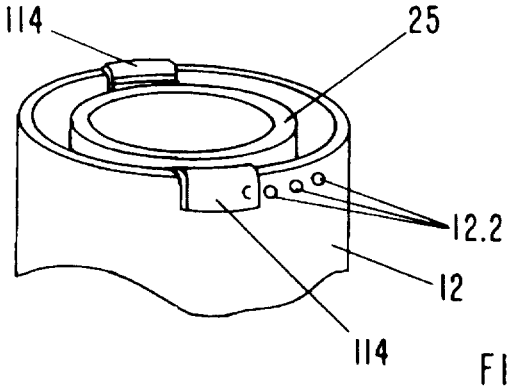
FIG. 4 shows in a perspective side view the upper end of a balloon limiter with yarn guide eyelets arranged opposite to one another.
Figure 5:
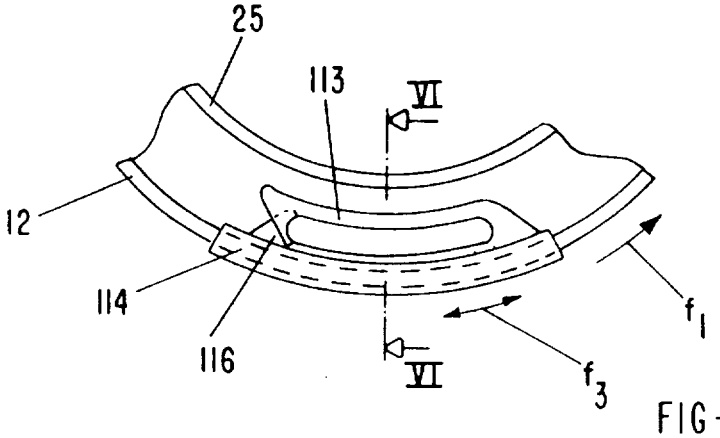
FIG. 5 shows a plan view of a displaceable yarn guide eyelet according to FIG. 4.
Figure 6:
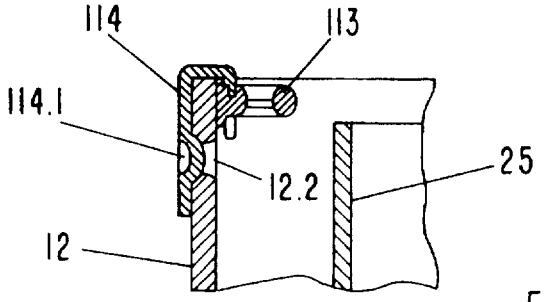
FIG. 6 shows a section along the line VI—VI of FIG. 5.

FIGS. 4 to 6 show an elongate yarn guide eyelet 113 which can be displaced in the direction of the double arrow f3 relative to the balloon limiter 12. The yarn guide eyelet 13 is connected with a clampable clamping body 114 to the upper edge of the balloon limiter. The balloon limiter may be provided with arresting elements, for example, catch openings 12.2 for clamping noses 114.1 provided at the clamping body 114. The yarn guide eyelet 113 is formed by a bracket-like ceramic body 115 which with one end according to the embodiment of FIG. 3 is elastically connected to the clamping body 114, while the other end is, for example, beak-shaped. For forming a closed eyelet the beak-shaped end cooperates by overlapping with an oppositely arranged, preferably also beak-shaped counter element 116.

At least the portions of the yarn guide eyelets 13, 113, 213 that are in contact with the yarn are comprised of a wear-resistant material or are coated with a wear-resistant material.

Figure 7:
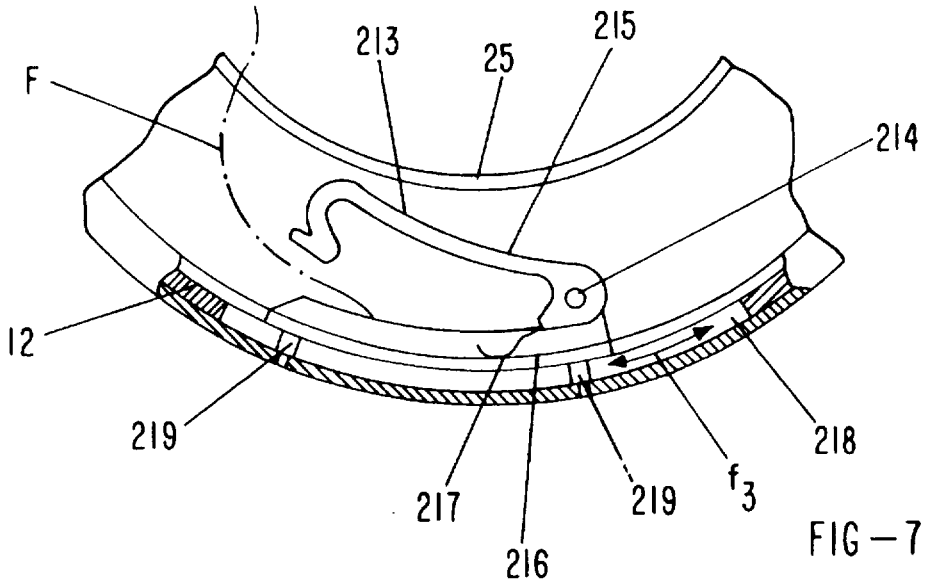
FIGS. 7 and 8 show a further embodiment of a balloon limiter with a yarn guide eyelet connected thereto in a first open position (FIG. 7) for receiving the yarn when the balloon limiter is standing still and in a second, closed position (FIG. 8) when the balloon limiter is rotating.
Figure 8:
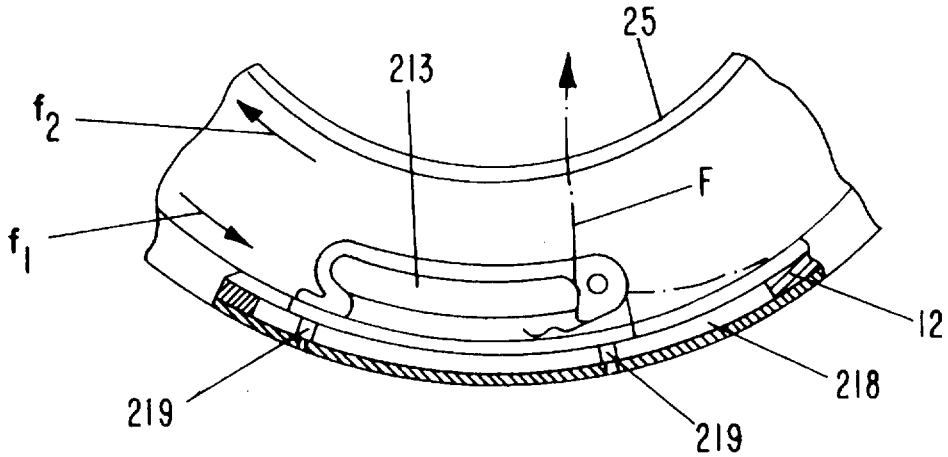
Figure 9:
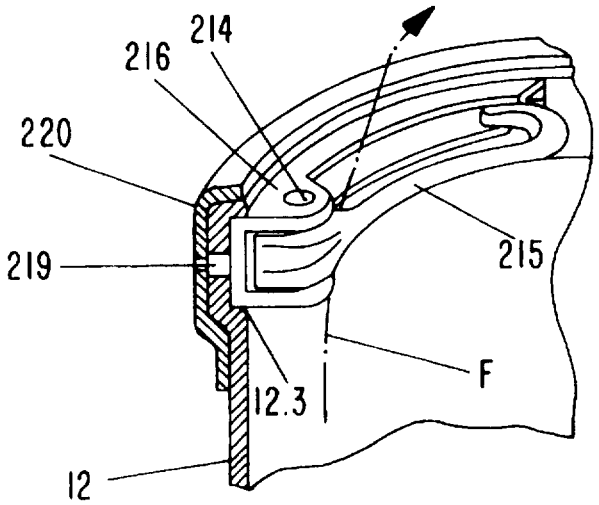
FIG. 9 shows a side view of the yarn guide eyelet represented in FIG. 8.

FIGS. 7 to 9 show an elongate yarn guide eyelet 213 in the form of a bracket 215 which opens automatically upon a standstill of the spindle, wherein the bracket 215 is pivotably connected with the pivot 214 at a support 216 which is displaceably connected to the upper edge of the balloon limiter 12 and is displaceable in the direction of double arrow f3. A spring element 217 may engage the end of the bracket at the pivot 214 which spring element 217 is supported at the support 216. The spring element 217 forces, respectively, pivots the bracket 215 into the open position represented in FIG. 7. Upon rotation of the balloon limiter 12 the bracket 215 is moved by centrifugal force into the closed position represented in FIG. 8 so that a closed yarn guide eyelet 213 for the yarn F is formed.

For the displacement of the support body 216 the upper area of the balloon limiter is provided with a recess 12.3 for receiving the support body 216. A portion of the circumference of the balloon limiter 12 is provided with a slotted hole 218 within the recess. The support body 216 is connected via two bolts 219 to a rotatable ring 220 which is guided about the upper edge of the balloon limiter 12. In this manner, the oppositely arranged yarn eyelets 213 can be displaced together with the ring 220 whereby suitable locking elements, for example, according to the embodiments of FIGS. 4 and 6, are provided for arresting the rotatable ring 220.

The inventive method, i.e., the use of a rotatable balloon limiter with yarn guide eyelets connected thereto is usable also for a two-for-one twisting spindle in order to provide a sufficient yarn reservoir, respectively, yarn storage zone at the rotating inner wall of the balloon limiter after exiting of the yarn from the radial yarn guide channel of the spindle rotor. The yarn guide eyelet connected to the rotating balloon limiter in the upper area of the balloon limiter, as described above, can be used for a two-for-one twisting spindle in the same manner as described in connection with FIGS. 1 to 9.

Figure 11:
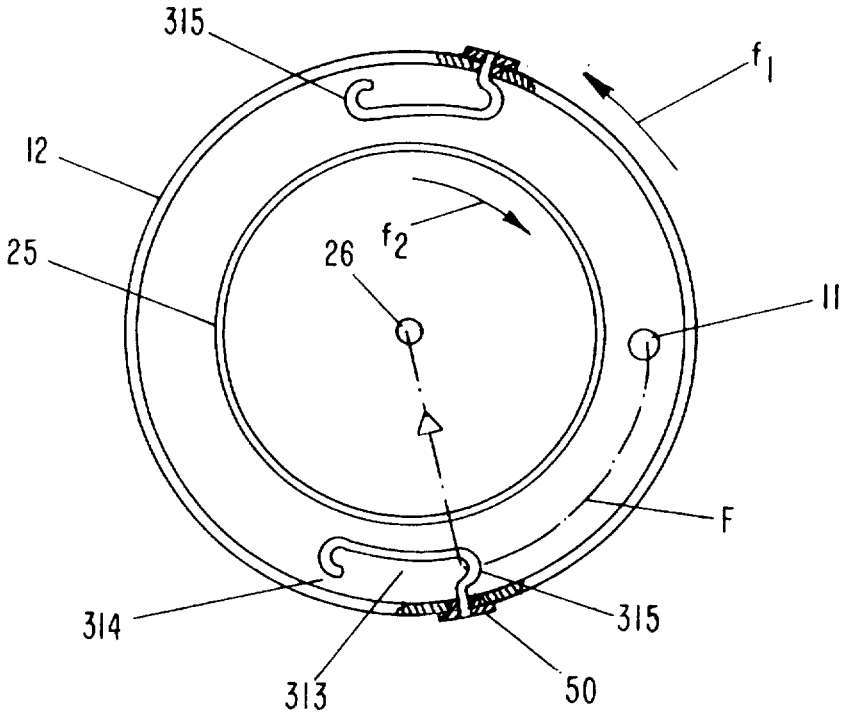

According to FIG. 11 the two yarn guide eyelets 313 which have the shape of a bracket 315 are arranged such that the openings 314 for threading the yarn f are facing the exit, i.e., the outlet 11 of the spindle rotor, relative to the rotational direction f1 of the balloon limiter 12. This arrangement requires a manual yarn threading, or, an additional yarn threading device is required.

Figure 10:
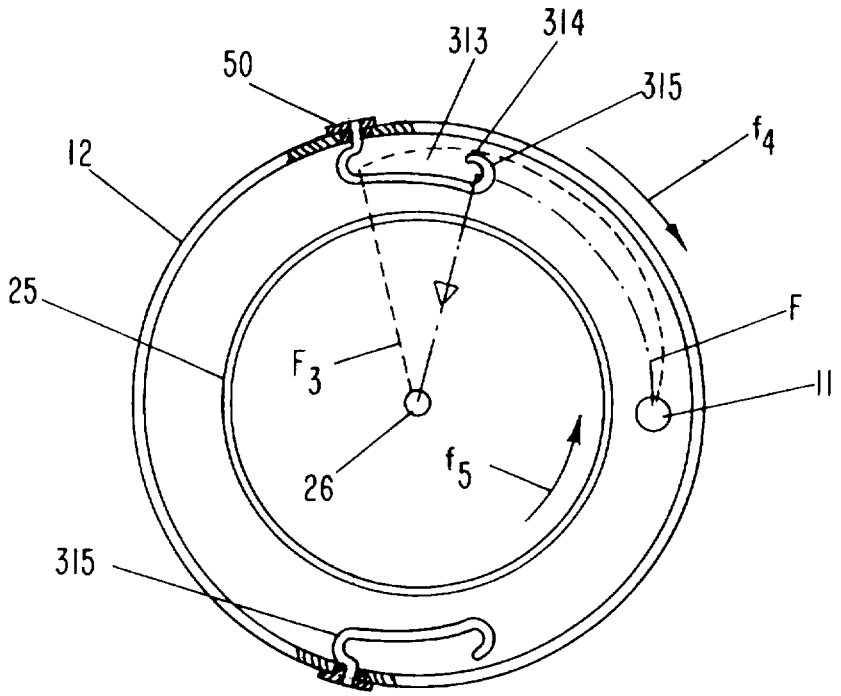
FIGS. 10 and 11 show axial sections of special eyelet arrangements.

In the embodiment according to FIG. 10 the two yarn guide eyelets 313 which are also in the shape of brackets 315 are arranged relative to the rotational direction f4 of the balloon limiter 12 such that the openings 314 for threading the yarn F are facing the exit openings of the spindle rotor so that during startup of the spindle independent of the rotational direction of the spindle, respectively, of the balloon limiter, an automatic threading of the yarn takes place. According to FIG. 10 the spindle rotor rotates in the direction of arrow of f4.

The present invention is, of course, in no way restricted to the specific disclosure of the specification and drawings, but also encompasses any modifications within the scope of the appended claims.

What I claim is:

1. A method of building a yarn reserve at a balloon limiter, said method comprising the steps of:

positioning a bobbin on a spindle rotor comprising a hollow spindle axle and a cylindrical balloon limiter surrounding the hollow spindle axle;

providing a yarn guide channel extending radially outwardly from the hollow spindle axle and having an exit location radially outwardly of the hollow spindle axle and radially inwardly relative to the balloon limiter;

securing a yarn guide eyelet to an upper end of the balloon limiter so as to be positioned at an angular distance relative to the exit location of the yarn;

selecting the angular distance between 20° and 120° as a function of operating conditions;

arresting the yarn guide eyelet at the selected angular distance relative to the exit location;

withdrawing yarn from the bobbin through the hollow spindle axle and the yarn guide channel to the exit location; and guiding the yarn through the yarn guide eyelet for building a yarn reserve between the exit location and yarn guide eyelet upon rotation of the spindle rotor.

2. A method according to claim 1, wherein in said step of selecting the angular distance is selected as a function of the geometric conditions of the spindle rotor and of the rotational speed of the spindle rotor.

3. A method according to claim 1, wherein in said step of selecting the angular distance is selected as a function of the geometric conditions of the spool support and the rotational speed of the spool support.

4. A method according to claim 1, wherein in said step of selecting the angular distance is selected as a function of the tension conditions of the yarn during removal from the yarn supply.

5. A method according to claim 1, wherein in said step of selecting the angular distance is selected as a function of the tension conditions of the yarn during removal from the spool support.

6. A method according to claim 1, wherein in said step of selecting the angular distance is selected as a function of the properties of the yarn..

7. A multiple twisting spindle comprising:

a spindle rotor having an exit location for a yarn; and a rotating cylindrical balloon limiter surrounding said spindle rotor and having at an upper end thereof at least one yarn guide eyelet affixed thereto, said yarn guide eyelet spaced at an angular distance relative to said exit location of the yarn at said spindle rotor.

8. A multiple twisting spindle according to claim 7, wherein said at least one yarn guide eyelet is connected to an upper edge of said balloon limiter.

9. A multiple twisting spindle according to claim 8, wherein said upper edge of said balloon limiter is displaceable relative to said exit location of the yarn at said spindle rotor.

10. A multiple twisting spindle according to claim 9, wherein said upper edge of said balloon limiter is rotatably displaceable relative to said exit location of the yarn at said spindle rotor.

11. A multiple twisting spindle according to claim 7, wherein said balloon limiter comprises two of said yarn guide eyelet positioned opposite one another.

12. A multiple twisting spindle according to claim 7, wherein said at least one yarn guide eyelet is spaced at an angular distance of 20° to 120° in a rotational direction of said spindle rotor relative to said exit location of the yarn at said spindle rotor.

13. A multiple twisting spindle according to claim 7, wherein said at least one yarn guide eyelet has an elongate shape in a rotational direction of said balloon limiter.

14. A multiple twisting spindle according to claim 13, wherein said at least one yarn guide eyelet has a length corresponding to an angular distance of 10°0 to 20°.

15. A multiple twisting spindle according to claim 7, wherein said at least one yarn guide eyelet is connected in a displaceable manner to said balloon limiter.

16. A multiple twisting spindle according to claim 7, wherein said yarn guide eyelet is comprised of a bracket with a first and a second end and an elastically deformable holder, said first end of said bracket elastically connected with said holder to said balloon limiter, wherein said second end of said bracket is beak-shaped and wherein said balloon limiter opposite said second end of said bracket has an opening.

17. A multiple twisting spindle according to claim 16, wherein said balloon limiter is displaceable relative to said exit location of the yarn at said spindle rotor.

18. A multiple twisting spindle according to claim 17, wherein said balloon limiter is rotatably displaceable relative to said exit location of the yarn at said spindle rotor.

19. A multiple twisting spindle according to claim 7, wherein said yarn guide eyelet is comprised of a bracket with a first and a second end and a clamping element displaceably clamped onto said balloon limiter, said first end elastically pivotably connected to said clamping element, wherein said second end of said bracket is beak-shaped and wherein said balloon limiter opposite said second end of said bracket has a counter element for cooperating in an overlapping manner with said second end of said bracket.

20. A multiple twisting spindle according to claim 19, wherein said counter element is beak-shaped.

21. A multiple twisting spindle according to claim 7, wherein said yarn guide eyelet is comprised of a bracket with a first and a second end and a support element connected to said balloon limiter, wherein said first end of said bracket is pivotably connected to said support element, said yarn guide eyelet further comprising a spring element engaging said first end of said bracket such that, when said balloon limiter is standing still, said yarn guide eyelet is forced into an open position and, when said balloon limiter is in rotation, said second end of said yarn guide eyelet is closed due to centrifugal forces.

22. A multiple twisting spindle according to claim 21, wherein:

said balloon limiter has an upper end;

said balloon limiter comprises a rotary ring connected to said upper end thereof; and two said yarn guide eyelets are connected to said rotary ring so as to be oppositely positioned.

23. A multiple twisting spindle according to claim 7, wherein at least portions of said yarn guide eyelets that are contacted by the yarn are made of a wear-resistant material.

24. A multiple twisting spindle according to claim 7, wherein at least portions of said yarn guide eyelets that are contacted by the yarn are coated with a wear-resistant material.

25. A multiple twisting spindle according to claim 7 in the form of a three-for-one twisting spindle, wherein said balloon limiter is fixedly connected to said spindle rotor rotating in a first direction, and further comprising a spool support rotatable in a direction opposite said first direction.

26. A multiple twisting spindle according to claim 7, in the form of a two-for-one twisting spindle, wherein said balloon limiter is fixedly connected to said spindle rotor.

27. A multiple twisting spindle according to claim 7, wherein said yarn guide eyelet has a threading opening that in a circumferential direction of said balloon limiter is open in a direction toward said exit location at said spindle rotor.

28. A multiple twisting spindle according to claim 7, wherein said yarn guide eyelet has a threading opening that in a circumferential direction of said balloon limiter is open in a direction facing away from said exit location of the yarn at said spindle rotor.

29. A multiple twisting spindle comprising:

a spindle rotor comprising a hollow spindle axle and a cylindrical balloon limiter with an inner cylindrical wall surrounding said hollow spindle axle, and further comprising a yarn guide channel connected to said hollow spindle axle and having an exit location radially outwardly relative to said hollow spindle axle and radially inwardly relative to said balloon limiter;

at least one yarn guide eyelet adjustably secured to the upper edge of said balloon limiter so as to be spaced at an angular distance relative to said exit location; and a means for arresting said at least one yarn guide eyelet at said upper edge of said balloon limiter after selecting said angular distance according to operating conditions, wherein said inner cylindrical wall of said balloon limiter is a storage zone for yarn withdrawn from a bobbin positioned on said multiple twisting spindle.

30. A multiple twisting spindle comprising:

a spindle rotor comprising a hollow spindle axle and a cylindrical balloon limiter with an inner cylindrical wall surrounding said hollow spindle axle, and further comprising a yarn guide channel connected to said hollow spindle axle and having an exit location radially outwardly relative to said hollow spindle axle and radially inwardly relative to said balloon limiter;

at least one yarn guide eyelet secured to the upper edge of said balloon limiter;

means for adjusting the location of said at least one yarn guide eyelet relative to said exit location so as to provide an angular distance between said at least one yarn guide eyelet and said exit location according to operating conditions; and means for arresting said at least one yarn guide eyelet and said exit location relative to one another at said angular distance after selecting said angular distance, wherein said inner cylindrical wall of said balloon limiter is a storage zone for yarn withdrawn from a bobbin positioned on said multiple twisting spindle.

* * * * *